US005174465A

United States Patent [19]

Luch et al.

[11] Patent Number: 5,174,465

[45] Date of Patent: Dec. 29, 1992

[54] ONE-PIECE FITMENT AND CAP WITH TAMPER-EVIDENT BAND

[75] Inventors: Daniel Luch, Los Gatos; Brian M. Adams, Newark, both of Calif.

[73] Assignee: Cap Snap Co., San Jose, Calif.

[21] Appl. No.: 780,774

[22] Filed: Oct. 22, 1991

Related U.S. Application Data

[63] Continuation-in-part of Ser. No. 664,658, Mar. 5, 1991.

[51] Int. Cl.[5] ..... B65D 41/34; B65D 55/02; B65D 39/08

[52] U.S. Cl. ..... 220/288; 220/254; 220/266; 215/356; 215/216; 229/125.15

[58] Field of Search ..... 220/265, 254, 266, 270, 220/276, 307, 359, 269, 601, 661; 215/253, 254, 255, 256, 214, 356, 218, 221

[56] References Cited

U.S. PATENT DOCUMENTS

| | | | |
|---|---|---|---|
| Re. 32,891 | 3/1989 | Smith | 229/179 |
| 2,168,608 | 8/1939 | O'Brien et al. . | |
| 3,083,858 | 4/1963 | Biedenstein | 220/265 |
| 3,187,966 | 6/1965 | Klygis | 220/265 X |
| 3,204,829 | 9/1965 | Song . | |
| 3,282,477 | 11/1966 | Henchert | 222/541 |
| 3,608,771 | 9/1971 | Monroe et al. | 220/266 |
| 3,744,662 | 7/1973 | Zundel | 220/269 |
| 3,744,675 | 7/1973 | Song | 222/153 |
| 3,891,118 | 6/1975 | Laurizio | 220/288 |
| 3,924,769 | 12/1975 | Fillmore | 215/216 |
| 3,935,968 | 2/1976 | Rausing | 215/356 X |
| 3,966,080 | 6/1976 | Bittel | 220/269 |
| 3,998,354 | 12/1976 | Song | 220/269 |
| 4,034,896 | 7/1977 | Wilson | 220/601 X |
| 4,036,385 | 7/1977 | Morris | 215/209 |
| 4,146,148 | 3/1979 | Dwinell et al. | 222/270 |
| 4,172,533 | 10/1979 | Montgomery | 215/216 |
| 4,231,486 | 11/1980 | Bock | 215/355 X |
| 4,231,488 | 11/1980 | Ward et al. | 220/258 |
| 4,280,634 | 7/1981 | Wiesenberger et al. | 220/270 |
| 4,345,690 | 8/1982 | Hopley | 215/216 |
| 4,360,113 | 11/1982 | Luker | 215/216 |
| 4,362,255 | 12/1982 | Bond | 222/107 |
| 4,399,924 | 8/1983 | Nilsson | 220/257 |
| 4,483,464 | 11/1984 | Nomura | 222/83 |
| 4,630,743 | 12/1986 | Wright | 215/216 |
| 4,657,143 | 4/1987 | Forbes, Jr. | 206/626 |
| 4,669,640 | 6/1987 | Ando et al. | 220/266 X |
| 4,705,197 | 11/1987 | Gordon et al. | 206/604 |
| 4,770,325 | 9/1988 | Gordon et al. | 222/481 |
| 4,813,578 | 3/1989 | Gordon et al. | 222/541 |
| 4,830,273 | 5/1989 | Kalberer et al. | 229/123.1 |
| 4,890,770 | 1/1990 | Haga et al. | 222/109 |
| 4,909,434 | 3/1990 | Jones et al. | 229/125.15 |
| 4,913,292 | 4/1990 | Field | 206/611 |
| 4,949,882 | 8/1990 | Take | 222/528 |
| 4,964,562 | 10/1990 | Gordon | 229/125.15 |
| 4,972,568 | 11/1990 | Schurr | 220/601 X |
| 5,012,959 | 5/1991 | Gordon | 222/535 |
| 5,020,686 | 6/1991 | Dutt | 220/276 |
| 5,020,690 | 6/1991 | Kishikawa et al. | 222/83 |

*Primary Examiner*—Allan N. Shoap
*Assistant Examiner*—Vanessa Caretto
*Attorney, Agent, or Firm*—Julian Caplan

[57] ABSTRACT

A fitment and cap therefor are integrally molded with lugs interconnecting the part. The fitment has a flange to be attached to a container and an internally threaded spout. The cap has an externally threaded skirt. The lugs are diametrically spaced and interconnect the bottom edge of the skirt and upper edge of the spout. After molding, force is applied to break the lugs and snap the skirt inside the spout, the threads slipping past each other and inter-engaging. A temper-evident band extends around the skirt and is connected thereto by frangible bridges. At diametrically spaced locations vertically projecting fingers extend down from the tamper evident band and are received in sockets on the fitment flange shaped so that the band fingers prevent unscrewing the cap without removing the tamper-evident band. A pull tab and thumb tab assist the consumer in removing the tamper evident band so that the cap may be unscrewed from the fitment.

18 Claims, 1 Drawing Sheet

ONE-PIECE FITMENT AND CAP WITH TAMPER-EVIDENT BAND

CROSS-REFERENCE TO RELATED APPLICATIONS

This application is a continuation-in-part of U.S. application Ser. No. 07/664,658, filed Mar. 5, 1991, entitled SPOUT FITMENT CLOSURE PLUG.

BACKGROUND OF THE INVENTION

1. Field of the Invention

This invention relates to a new and improved spout fitment and a plug type cap for closing same. More particularly, the invention relates to a fitment which fits around a hole in a panel of a paperboard carton or around a hole in a flexible container, or the like, such as used for packaging liquid products and powders and to a closure for such fitment.

2. Description of Related Art

Generally speaking, prior fitments have spouts with external threads closed by caps with internal threads. Some fitments are used in conjunction with plastic bag containers, the fitment being integrally welded to the plastic bag. Other prior art fitments are attached to a polymer-coated paperboard container such as a gable-top half-gallon container. Generally, prior art fitments for paperboard cartons include a thin flange which is welded to the surface of the container. The closure includes a foil seal which seals the mouth of the spout and a liner for the cap which serves a resealing function. Attachment to the polymer coated paperboard is accomplished by welding the flange of the spout to the polymer coating. Upon initial removal, the tamper-evident foil seal is removed and discarded.

Fitments of the prior art have a number of deficiencies as compared to the present invention. In the first place, they employ multiple components which increase the cost of the combination very greatly over the simple structure of the present invention. Secondly, the assembly is difficult and involves rotary equipment which is difficult to control in practice and is expensive to install. Thirdly, because of the fact that the prior art spouts are externally threaded, the diameter of the opening in the spout is restricted inasmuch as there is only limited space on the panel of the container on which the flange can be located, thereby reducing the diameter of the fitment flange and correspondingly the internal diameter of the spout. Finally, commercially available fitment-closure combinations have no external tamper-evident features, demonstrated, for example, by the internal foil seal of the spout opening of the prior art.

All of the foregoing deficiencies are eliminated in the present invention.

SUMMARY OF THE INVENTION

The present invention comprises a fitment having an internally threaded spout and a cap therefore having an externally threaded skirt. Around the cap is a tamper-evident band connected thereto by a frangible line of weakness. Depending from the tamper-evident band are diametrically opposed fingers and extending upward from the fitment flange are diametrically opposed sockets shaped to receive the cap fingers and so constructed as to restrain unscrewing of the cap so long as the tamper-evident band is intact.

Initially, the cap and fitment are preferably molded in a single mold and the two parts are connected together by frangible bridges or gates joining the cap skirt and the upper edge of the fitment spout. Either in the final stage of the molding process or separately, the cap is depressed relative to the fitment by a straight axial push. The mating threads of the cap and spout slip over each other in this operation and seat in liquid-tight fashion. At the same time the fingers of the tamper-evident band are inserted into the sockets in the fitment. In this position, the cap cannot be unscrewed without removal of the tamper-evident band. The fitment flange is then attached to the container and the container is filled.

The consumer pulls off the tamper-evident band and then unscrews the cap.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 7:
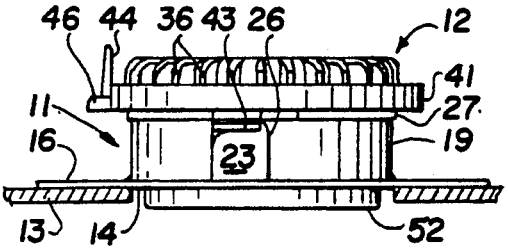
FIG. 7 is a view showing the cap assembled in the fitment and attached to a supporting container surface.
Figure 8:
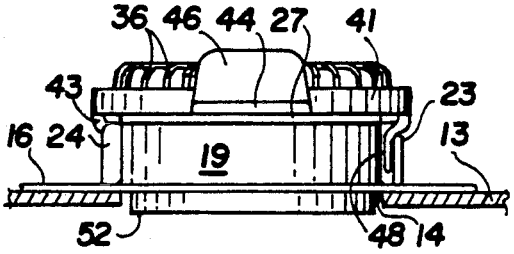
FIG. 8 is a view similar to FIG. 7 rotated 90 degrees.

The present invention comprises a fitment portion 11 and a cap portion 12. As shown in FIG. 7, the fitment is attached to a carton panel 13 having a hole 14 therein. It will be understood that the invention may be used with other container constructions.

Fitment portion 11 has an annular flange 16 which is attached to the container panel 13 surrounding the hole 14 therein. A downward-inward projection 17 on the lower edge of the inside of the flange 13 extends into the hole 14 in the panel 13. Plug seal surface 52 is formed on the exterior of the plug skirt vicinal its lower end. When assembled, plug seal surface 52 contacts flange 17 to form a primary seal for the assembly. It is noted that this arrangement permits both flange 17 and seal surface 52 to be molded without seam lines to ensure effective sealing. Various means may be used to join the flange 16 to the panel 13. Welding the flange to the panel is a preferred choice in the present invention.

Figure 1:
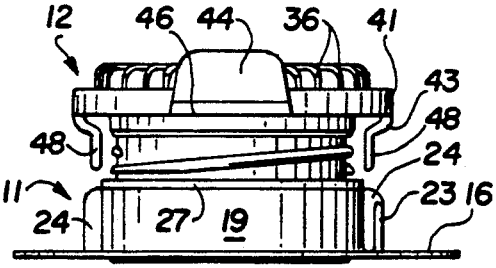
FIG. 1 is a side elevational view of the cap and fitment prior to assembly.
Figure 2:
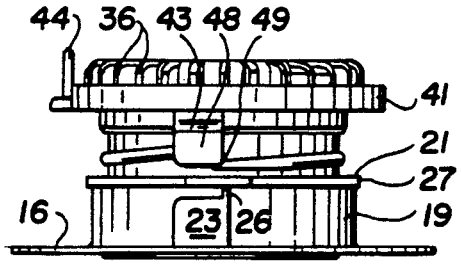
FIG. 2 is a view similar to FIG. 1 rotated 90 degrees.
Figure 3:
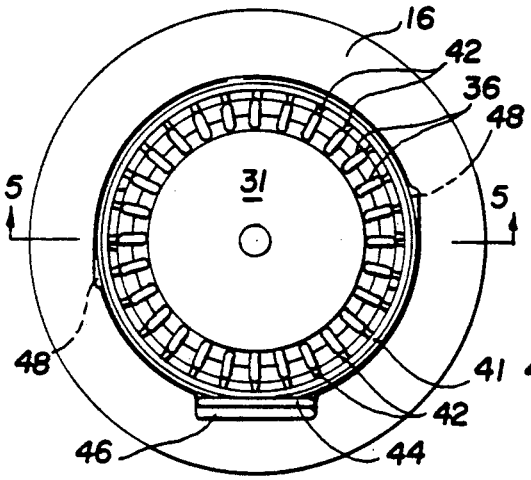
FIG. 3 is a top plan view of the structure of FIG. 1.
Figure 4:
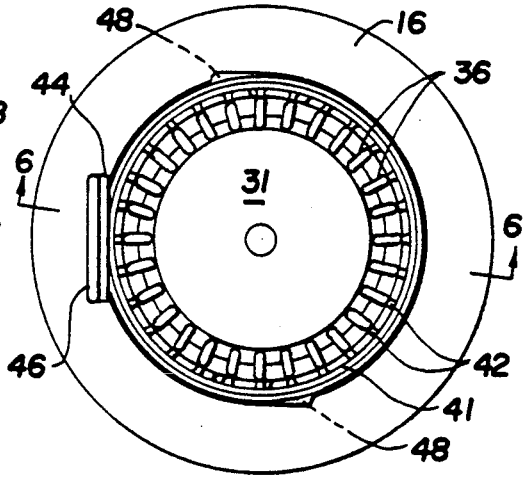
FIG. 4 is a top plan view of the structure of FIG. 2.
Figure 5:
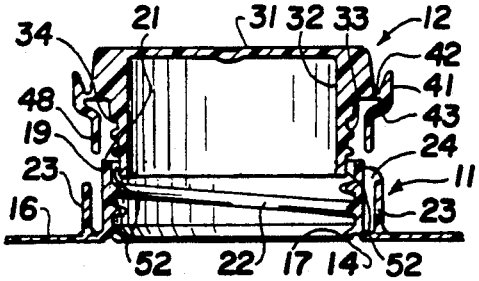
FIG. 5 is a sectional view taken substantially along the line 5—5 of FIG. 3.
Figure 6:
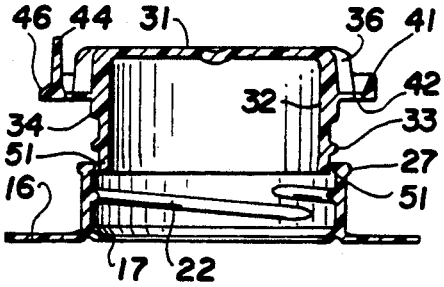
FIG. 6 is a sectional view taken substantially along the line 6—6 of FIG. 4.

Projecting upward from the inside of the flange 16 is a spout 19 having a top edge 21. Internal threads 22 are formed in the spout 19. Spaced outwardly of spout 19 and projecting upward from flange 16 is a socket wall 23 which is parallel to a tangent to the outside of the spout 19. One end of wall 23 is closed off by a radial socket wall end 24. As shown in the accompanying drawings, there are two socket walls 23 diametrically spaced apart. It will be understood that a single socket or more than two sockets may be used. Socket wall 23 has an upward projection 26 which joins the socket end wall 24, as best shown in FIG. 2. The outer wall of spout 19 is formed with an upward projecting peripheral flange 27 immediately below its top edge 21. The flange 27 is continuous except immediately above socket walls 23.

Cap portion 12 has a top disk 31 from which depends skirt 32, which is formed with external threads 33 to mate with the threads 22. Shoulder 34 is formed at the upper end of the threads 33. External ribs 36 curve from the periphery of top disk 31 downwardly and assist the user in gripping the cap portion 12 to unscrew it from the fitment. Surrounding skirt 32 and spaced outwardly thereof is a horizontal tamper-evident band 41. The lower edge of band 41 is connected to the skirt 32 by frangible bridges 42 which may constitute extensions of the lower edges of ribs 36. Thus the bridges 42 alternate with voids therebetween to form a line of weakness between band 41 and skirt 32. It will be understood that other means may be used to create a line of weakness between the band 41 and the skirt 32. In at least one location, there is an upward-extending pull tab 44 integral with the band 41 and projecting upward so that it may be conveniently gripped by the consumer to tear off the band 41. As a further means to facilitate tearing off the band 41, at least one outward-projecting thumb tab 46 is provided. Thus the consumer may either grip the tab 44 and pull upward or insert a finger or thumb under the tab 46 and pull upward to remove band 41.

Extending downward from band 41 in one or more locations (here shown as two in number) are tamper-evident fingers 48 which are rectangular, in horizontal cross-section and shaped parallel to a tangent drawn to the exterior of skirt 32. The fingers 48 are joined to the band 41 by downward-inward curved connections 43.

The cap portion 12 and fitment portion 11 are initially connected together by frangible radial lugs or gates 51 joining the edge of skirt 32 to the top edge 21 of spout 19. The lugs or gates are preferably positioned radially to coincide with the projected extension of helical thread 33, so that the gates form an effective thread runout. As illustrated, there are two diametrically spaced lugs 51, subject to variation. This is because the embodiment shown is a double lead thread. Either during a final ejection stage of the molding process or subsequently, the cap 12 is pushed down so that the skirt 32 slips inside the spout 19. Threads 33 and 22 are so shaped and positioned that they will slip past each other in registration during this downward movement. The fingers 48 are so located with reference to the socket walls 23 that a straight downward push of the cap 12 seats the fingers 48 inside the socket walls 23 and adjacent the socket end walls 24.

End walls 24 prevent the cap 12 from being unscrewed because the fingers 48 abut thereagainst. If one attempts to unscrew the cap 12, the fingers 48 encountering the walls 24 prevent such turning. If the consumer forces turning of the cap 12, fracture of the bridges 42 occurs, thereby giving evidence of tampering.

In a preferred use of the device, the consumer either pulls upward on tab 44 or raises the tab 46, causing the band 41 to be disconnected from the cap 12 by fracturing the bridges 42. The cap 12 may then be unscrewed. Cap 12, of course, serves as a reclosure cap until the contents of the container are consumed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed:

1. An intermediate product comprising in combination, a fitment and a cap therefor, said fitment comprising an annular flange having a hole, a spout upstanding from said flange surrounding said hole, first helical attachment means on said spout, said cap having a top, a skirt depending from said top, second helical attachment means on said skirt cooperable with said first helical attachment means to tighten said cap on said fitment when said cap is turned in a first direction and loosen said cap when said cap is turned in a second direction opposite said first direction, characterized by a tamper-evident ring surrounding said skirt, frangible means detachably connecting said ring to said skirt, first locking means attached to said ring, complementary second locking means fixed to said fitment shaped and positioned to receive said first locking means to restrain loosening said cap so long as said frangible means is intact, said frangible means when broken permitting unscrewing of said cap from said fitment, said first helical attachment means comprising internal threads on said spout and said second helical attachment means comprising external threads on said skirt mating with said internal threads, at least one of said skirt and said spout being flexible and said first and second helical attachment means being shaped so that when said cap is moved directly axially downward relative to said spout, said first and second helical attachment means slip past each other and then interengage, and said first locking means is received in said second locking means.

2. The combination of claim 1 in which said first locking means comprises a finger depending from said ring and said second locking means comprises a socket shaped and positioned to receive said finger.

3. The combination according to claim 1 in which said ring comprises a member spaced outward from said skirt.

4. The combination of claim 2 which further comprises at least one downward-inward connection extending from a bottom of said ring connected to said finger.

5. The combination of claim 1 in which said frangible means comprises a plurality of thin bridges separated by spaces extending inward from said ring to said skirt.

6. The combination of claim 1 in which said skirt has an exterior and which further comprises radial finger-grip ribs spaced around said exterior of said skirt.

7. The combination of claim 2 in which said finger is rectangular in horizontal cross-section, the width of said finger being positioned parallel to a horizontal tangent to said skirt.

8. The combination of claim 7 in which said socket comprises a vertical socket wall disposed outwardly relative to said finger.

9. The combination of claim 8 in which said socket wall is substantially parallel to a horizontal tangent to said spout.

10. The combination of claim 8 which further comprises a substantially radial socket end wall extending substantially radially between one end of said socket wall and the exterior of said spout.

11. The combination of claim 1 which further comprises a pull tab fixed to and extending upwardly from said ring, whereby pulling said tab breaks said frangible means.

12. The combination of claim 1 which further comprises a thumb tab extending substantially horizontally outward from said ring, whereby lifting said thumb tab breaks said frangible means.

13. The combination of claim 1 which further comprises lugs initially interconnecting said cap and said fitment whereby said cap and said fitment may be injection molded in one piece.

14. The combination of claim 13 in which said lugs are frangible and said first and second helical attachment means are sufficiently flexible so that said cap and spout may be pressed together in an axial movement, said lugs breaking and said helical attachment means slipping past each other to fully seat said skirt on said spout.

15. The combination of claim 14 wherein said lugs are in alignment with lower ends of said second helical attachment means and comprise thread runout after said cap is separated from said fitment.

16. The combination of claim 2 wherein said finger is initially positioned immediately above said socket whereby said axial movement seats said finger in said socket.

17. The combination of claim 1 in which said spout has a lower edge and said cap skirt has a lower end and which further comprises an inward projection at said lower edge of said spout and a downward projection on said lower end of said cap skirt positioned to seal against said inward projection when said cap is seated on said spout.

18. The combination of claim 1 in which said second locking means comprises a socket shaped to receive said first locking means which comprises a wall positioned to engage said first locking means to restrain said first locking means when said cap is turned in said second direction.

* * * * *